US007919954B1

(12) United States Patent
Mannama et al.

(10) Patent No.: US 7,919,954 B1
(45) Date of Patent: Apr. 5, 2011

(54) LDO WITH OUTPUT NOISE FILTER

(75) Inventors: Vello Mannama, Tallinn (EE); Rein Sabolotny, Tallinn (EE)

(73) Assignee: National Semiconductor Corporation, Santa Clara, CA (US)

( * ) Notice: Subject to any disclaimer, the term of this patent is extended or adjusted under 35 U.S.C. 154(b) by 729 days.

(21) Appl. No.: 11/549,030

(22) Filed: Oct. 12, 2006

(51) Int. Cl.
*G05F 1/40* (2006.01)

(52) U.S. Cl. ..... 323/272

(58) Field of Classification Search ..... 323/265, 323/272, 273, 275, 282, 285
See application file for complete search history.

(56) References Cited

U.S. PATENT DOCUMENTS

| | | | | |
|---|---|---|---|---|
| 4,924,115 | A | 5/1990 | Yazdy | |
| 4,983,905 | A | 1/1991 | Sano et al. | |
| 5,600,234 | A * | 2/1997 | Hastings et al. | 323/282 |
| 6,031,362 | A * | 2/2000 | Bradley | 323/269 |
| 6,114,843 | A | 9/2000 | Olah | |
| 6,188,211 | B1 | 2/2001 | Rincon-Mora et al. | |
| 6,232,757 | B1 | 5/2001 | Afghahi et al. | |
| 6,278,320 | B1 | 8/2001 | Vu | |
| 6,346,851 | B1 | 2/2002 | Zhang et al. | |
| 6,459,246 | B1 | 10/2002 | Roo | |
| 6,459,331 | B1 | 10/2002 | Takeuchi et al. | |
| 6,518,737 | B1 * | 2/2003 | Stanescu et al. | 323/280 |
| 6,522,114 | B1 | 2/2003 | Bakker et al. | |
| 6,559,715 | B1 | 5/2003 | Frake et al. | |
| 6,677,737 | B2 | 1/2004 | Hamon et al. | |
| 6,703,813 | B1 | 3/2004 | Vladislav et al. | |
| 6,703,815 | B2 * | 3/2004 | Biagi | 323/280 |
| 6,765,374 | B1 * | 7/2004 | Yang et al. | 323/280 |
| 6,861,827 | B1 * | 3/2005 | Yang et al. | 323/273 |
| 6,965,223 | B1 | 11/2005 | MacLean et al. | |
| 6,975,099 | B2 * | 12/2005 | Wu et al. | 323/280 |
| 7,015,680 | B2 | 3/2006 | Moraveji et al. | |
| 7,019,499 | B2 | 3/2006 | Chiu et al. | |
| 7,030,598 | B1 | 4/2006 | Dow | |
| 7,057,447 | B1 | 6/2006 | Tiwari | |
| 7,397,226 | B1 * | 7/2008 | Mannama et al. | 323/273 |
| 7,446,515 | B2 * | 11/2008 | Wang | 323/280 |
| 2007/0210770 | A1 * | 9/2007 | Dean | 323/273 |

OTHER PUBLICATIONS

"LP5900 Ultra Low Noise, 100 mA Linear Regulator for RF/Analog Circuits Requires No Bypass Capacitor," National Semiconductor Corporation, Oct. 2005, pp. 1-11.
"LT1761 Series 100mA, Low Noise, LDO Micropower Regulators in SOT-23," Linear Technology Corporation, 1999, 1-16.
"MAS9123 80mA LDO Voltage Regulator IC," Micro Analog Systems, Sep. 4, 2001.

(Continued)

*Primary Examiner* — Adolf Berhane
(74) *Attorney, Agent, or Firm* — Frommer Lawrence & Haug LLP; Matthew M. Gaffney

(57) ABSTRACT

A low-drop out (LDO) regulator is provided. In one embodiment, the LDO regulator includes an error amplifier, a pass transistor, a reference voltage circuit, an output noise filter, and a voltage divider. The voltage divider provides a feedback voltage based on the output voltage. Further, the feedback voltage is provided at a feedback node. The output of the error amplifier is coupled to the pass transistor. The reference voltage circuit is coupled to a first input of the error amplifier. The output noise filter is coupled between the feedback node and the second input of the error amplifier.

21 Claims, 7 Drawing Sheets

OTHER PUBLICATIONS

"MAS9162 80mA LDO Voltage Regulator IC," Micro Analog Systems, May 13, 2002.

Hoon et al.: "A Low Noise, High Power Supply Rejection Low Dropout Regulator for Wireless System-on-Chip Applications," IEEE 2005 Custom Integrated Circuits Conference, pp. 759-762, 2005.

Leung at al.: "A Low-Voltage CMOS Low-Dropout Regulator with Enhanced Loop Response," IEEE, 2004, pp. 385-388.

* cited by examiner

LDO WITH OUTPUT NOISE FILTER

FIELD OF THE INVENTION

The invention is related to regulators, and in particular but not exclusively, to an ultra-low noise LDO regulator with an output noise filter.

BACKGROUND OF THE INVENTION

Most electronic devices include a power supply with a regulated voltage. Typically, semiconductor based electronic devices operate at relatively low direct current voltages such as five volts or less. However, much of the electrical energy to power electronic devices is made available at substantially larger voltages. For example, residential electrical power in the United States is nominally rated at 120 volts AC. Also, automotive power is nominally 12 volts DC, which is often subject to relatively high voltage transients during engine start and other changing load conditions.

Power supplies are generally employed to match the requirements of electronic devices to the available conditions of electrical power. Many electronic devices, for example hand held electronics, powered by batteries nominally within the voltage range of the electronics employ power supplies to compensate for non-linear discharge characteristics of batteries and to extract as much energy from the batteries as possible.

A power supply typically includes a voltage regulator to maintain voltage within a range of output values, e.g., five volts plus or minus two percent. If a voltage goes above the range of output values, it may damage the semiconductor device. Similarly, if the voltage goes below the range of output values, voltage compliance can be lost on one or more components of the electronic device, which may cause the device to stop operating. Also, changes in the output voltage of a power supply may induce noise into subsequent processing by other electronic devices and components.

Most voltage regulators include at least one voltage reference. The voltage reference provides a reference voltage that is typically compared against the output of the voltage regulator. Feedback circuitry is employed to adjust (stabilize) the output of the voltage regulator in regard to the reference voltage. Usually, a bandgap circuit is employed as the reference voltage. The term "bandgap" generally describes or refers to the energy difference between the top of the valence band and the bottom of the conduction band in insulators and semiconductors. To accommodate a voltage regulator that has a plurality of output voltages, the voltage reference is typically based on a minimum bandgap voltage.

BRIEF DESCRIPTION OF THE DRAWINGS

Non-limiting and non-exhaustive embodiments of the present invention are described with reference to the following drawings, in which.

DETAILED DESCRIPTION

Figure 1:
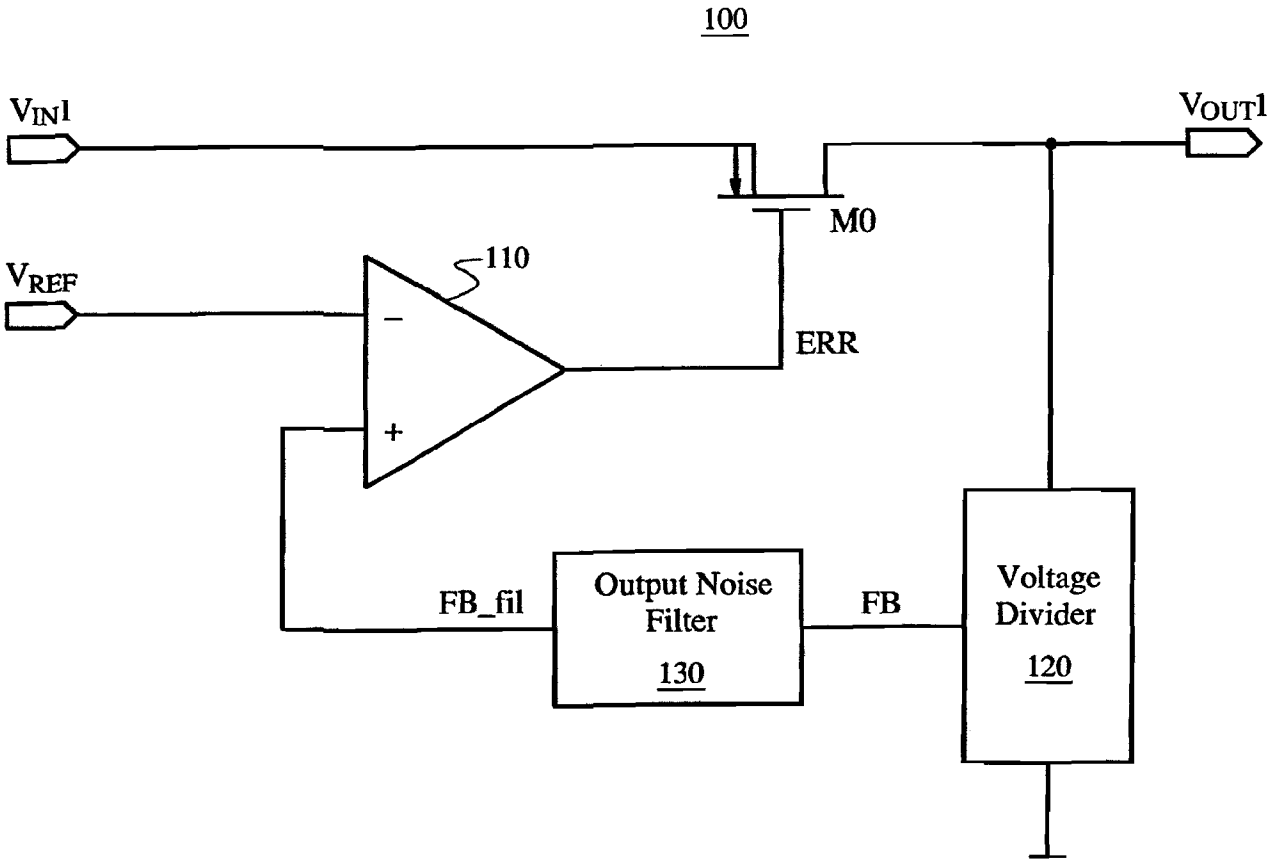
FIG. 1 shows a block diagram of an embodiment of a linear regulator.

Various embodiments of the present invention will be described in detail with reference to the drawings, where like reference numerals represent like parts and assemblies throughout the several views. Reference to various embodiments does not limit the scope of the invention, which is limited only by the scope of the claims attached hereto. Additionally, any examples set forth in this specification are not intended to be limiting and merely set forth some of the many possible embodiments for the claimed invention.

Throughout the specification and claims, the following terms take at least the meanings explicitly associated herein, unless the context dictates otherwise. The meanings identified below do not necessarily limit the terms, but merely provide illustrative examples for the terms. The meaning of "a," "an," and "the" includes plural reference, and the meaning of "in" includes "in" and "on." The phrase "in one embodiment," as used herein does not necessarily refer to the same embodiment, although it may. As used herein, the term "or" is an inclusive "or" operator, and is equivalent to the term "and/or," unless the context clearly dictates otherwise. The term "based, in part, on", "based, at least in part, on", or "based on" is not exclusive and allows for being based on additional factors not described, unless the context clearly dictates otherwise. The term "coupled" means at least either a direct electrical connection between the items connected, or an indirect connection through one or more passive or active intermediary devices. The term "circuit" means at least either a single component or a multiplicity of components, either active and/or passive, that are coupled together to provide a desired function. The term "signal" means at least one current, voltage, charge, temperature, data, or other signal. Where either a field effect transistor (FET) or a bipolar junction transistor (BJT) may be employed as an embodiment of a transistor, the scope of the words "gate", "drain", and "source" includes "base", "collector", and "emitter", respectively, and vice versa.

Briefly stated, the invention is related to a low-drop out (LDO) regulator. In one embodiment, the LDO regulator includes an error amplifier, a pass transistor, a reference voltage circuit, an output noise filter, and a voltage divider. The voltage divider provides a feedback voltage based on the output voltage. Further, the feedback voltage is provided at a feedback node. The output of the error amplifier is coupled to the pass transistor. The reference voltage circuit is coupled to a first input of the error amplifier. The output noise filter is coupled between the feedback node and the second input of the error amplifier.

FIG. 1 shows a block diagram of an embodiment of linear regulator 100. Linear regulator 100 may include error amplifier 110, pass transistor M0, voltage divider 120, and output noise filter 130.

In operation, error amplifier 110 provides an error signal ERR based, at least in part, on reference voltage Vref and filtered feedback signal FB_fil. In one embodiment, pass transistor M0 is arranged to provide output voltage Vout1 based on input voltage Vin1 and error signal ERR. Voltage divider 120 is arranged to provide feedback signal FB from output voltage Vout1. Also, output noise filter 130 is arranged to provide filtered output signal FB_fil from signal FB by filtering signal FB such at least part of the noise associated with voltage divider 120 is filtered out. Output noise filter 130 operates to suppress noise at the feedback input of error amplifier 120. In one embodiment, output noise filter 130 is an on-chip noise filter.

In one embodiment, although not shown in FIG. 1, output noise filter 230 includes a capacitive device and a resistive device arranged as a low pass-filter for low-pass filtering the feedback signal.

Figure 2:
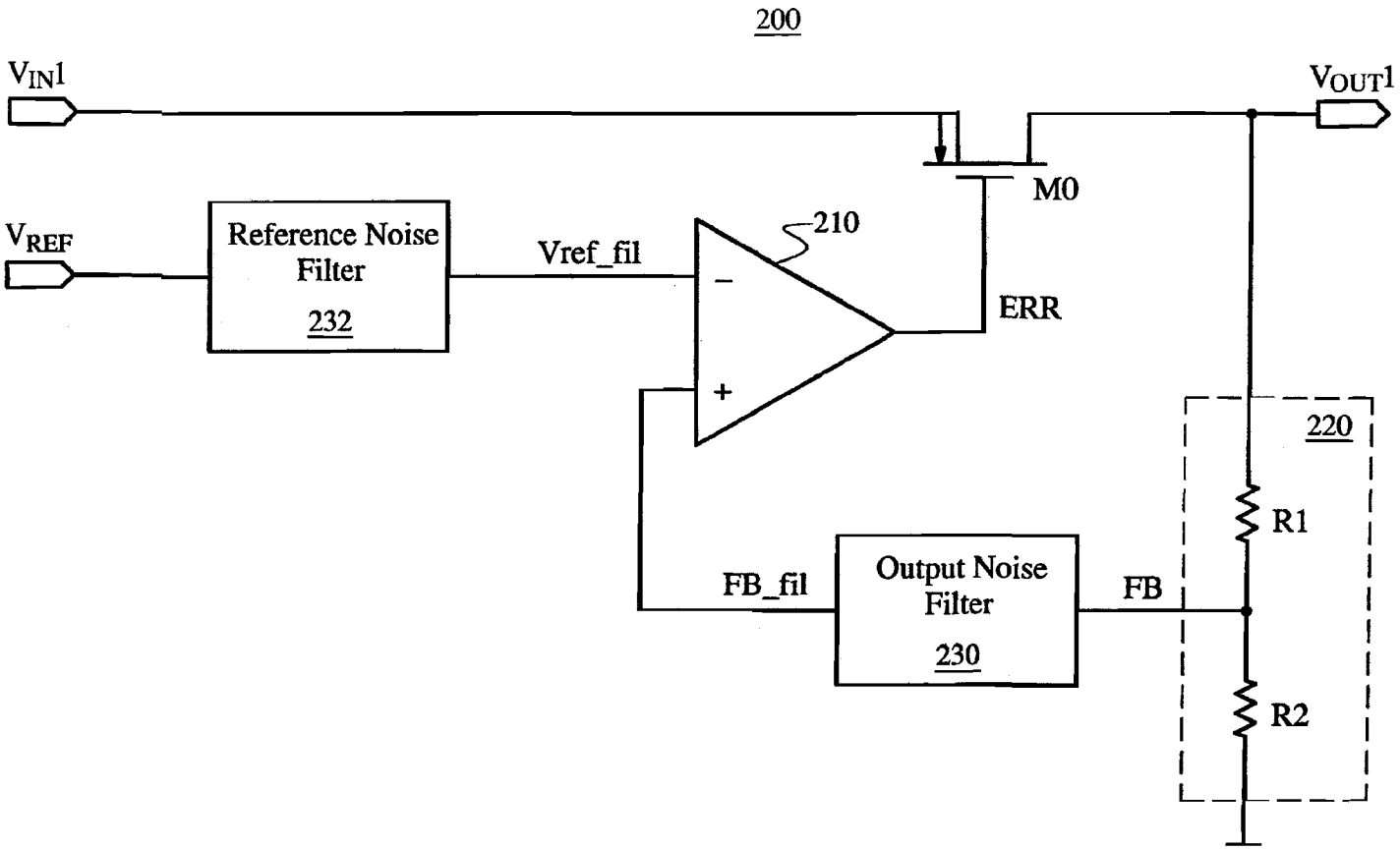
FIG. 2 illustrates a block diagram of an embodiment of the linear regulator of FIG. 1.

FIG. 2 illustrates a block diagram of an embodiment of linear regulator 200, which may be employed as an embodiment of linear regulator 100 of FIG. 1. Voltage divider 220 includes resistor R1 and resistor R2. Linear regulator 200 further includes reference noise filter 232. Reference noise filter 232 is arranged to provide filtered reference voltage Vref_fil from reference voltage Vref. In one embodiment, by synchronously operating the output noise filter with the reference noise filter, fast input and load transients may be maintained. Although not shown, reference voltage Vref may be provided by a reference voltage circuit, such as a bandgap reference circuit, or the like.

Figure 3:
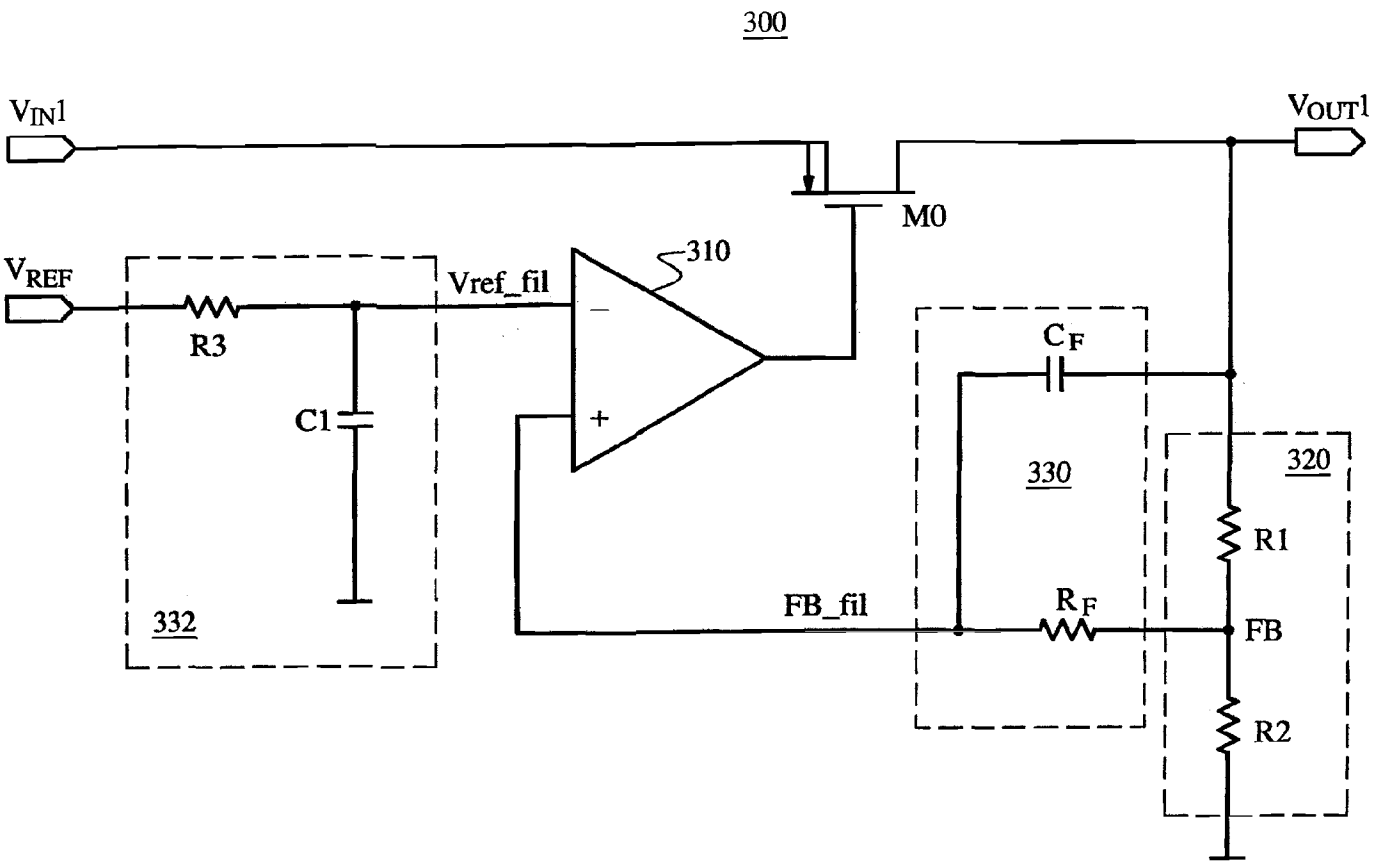
FIG. 3 shows a block diagram of an embodiment of the linear regulator of FIG. 2.

FIG. 3 shows a block diagram of an embodiment of the linear regulator 300, which may be employed as an embodiment of linear regulator 200 of FIG. 2. Reference noise filter 332 includes capacitor C1 and resistive device R3. Output noise filter 330 includes capacitor $C_F$ and resistive device $R_F$.

In one embodiment, capacitor $C_F$ is a single capacitor, and capacitor C1 is a single capacitor. In other embodiments, one or both of Capacitor $C_F$ and/or capacitor C1 may include two or more capacitors coupled together in series and/or in parallel to provide an equivalent capacitance.

In one embodiment, resistive device $R_F$ is a single resistor. In another embodiment, resistive device $R_F$ is a transistor biased to operate as a resistive device. In yet another embodiment, resistive device $R_F$ may include two or more resistive devices coupled together in series and/or in parallel to provide an equivalent resistance. Similarly, resistive device R1 may include one or more resistive devices.

Figure 4:
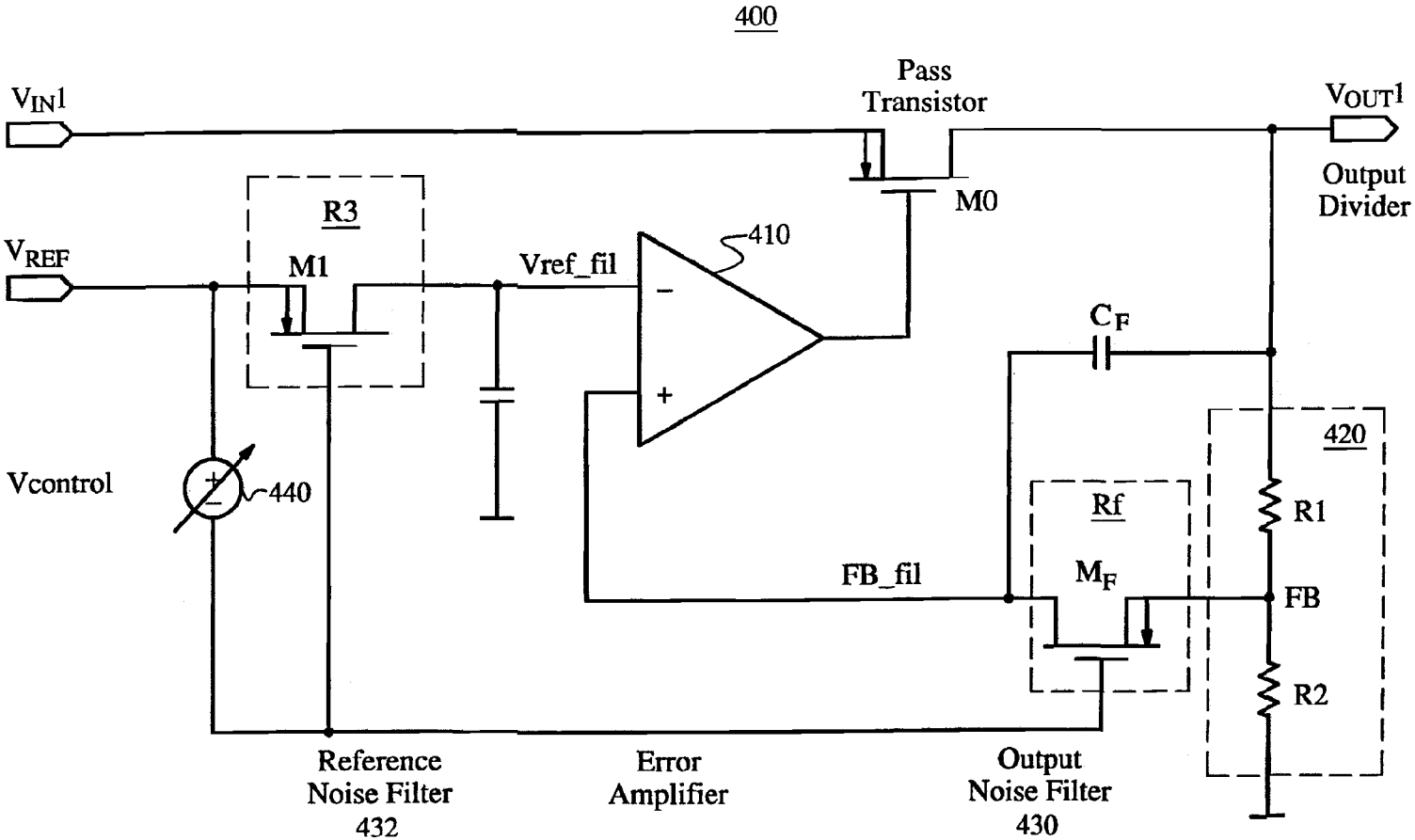
FIG. 4 illustrates a block diagram of an embodiment of the linear regulator of FIG. 3.

FIG. 4 illustrates a block diagram of an embodiment of linear regulator 400, which may be employed as an embodiment of linear regulator 300 of FIG. 3. Resistive device $R_F$ includes transistor $M_F$. Resistive device R3 includes transistor M1. Output noise filter 430 and reference noise filter 432 each further include control voltage source 440 which is shared by output noise filter 430 and reference noise filter 432 in one embodiment.

In one embodiment, control voltage source 440 is arranged to adjust control voltage Vcontrol during start-up to decrease the on-resistance of transistors MF and M1 during start-up, so that the RC time constants are faster during start up to ensure a faster start-up. After the start-up, control voltage Vcontrol is provided to bias each of the transistors MF and M1 as a resistive device with a resistance appropriate for operation in a noise filter.

Figure 5:
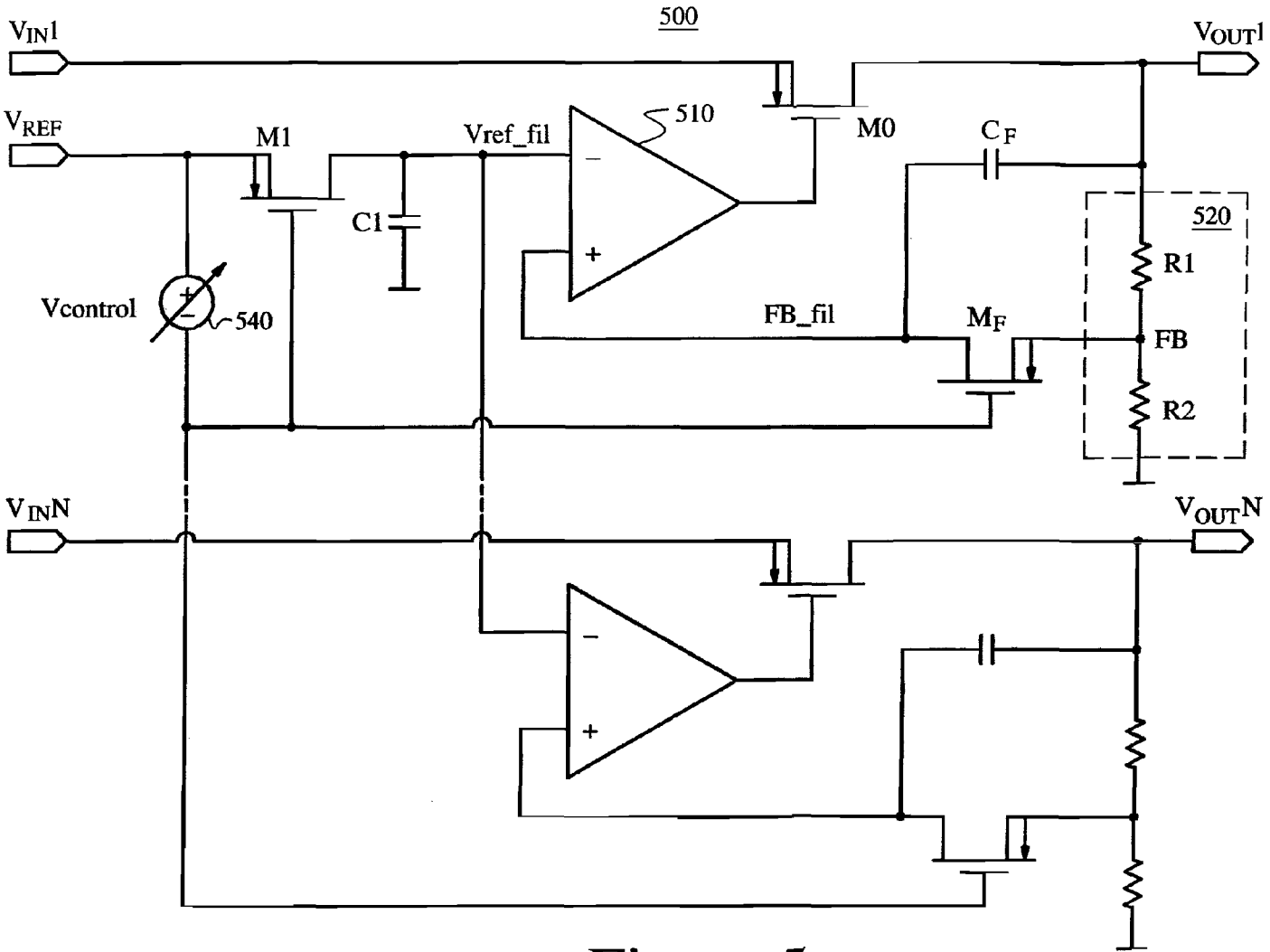
FIG. 5 shows a block diagram of an embodiment of the linear regulator of FIG. 4.

FIG. 5 shows a block diagram of an embodiment of the linear regulator 500, which may be employed as an embodiment of linear regulator 400 of FIG. 4. Linear regulator 500 is a multi-output LDO, suitable for use in, for example, a power management unit (PMU). In one embodiment, regulator 500 has two outputs. In other embodiments, regulator 500 has more than two outputs. Regulator 500 may have virtually any number of outputs.

Each separate LDO in circuit 500 includes a separate output noise filter. However, only a single reference noise filter is needed, which saves considerable die area compared to using a separate reference noise filter for each separate LDO output.

An embodiment of linear regulator 500 may achieve the following benefits:

ultra low output noise voltage, and multiple output possibilities with individual output dc level setting though the output divider, in conjunction with low quiescent current It may be possible to achieve ultra low output noise using a reference amplifier and noise filter. However, this approach consumes considerable chip area—a penalty for ultra low noise performance. This is especially remarkable in case of systems on chip with many low noise LDOs with different output voltage values. However, an embodiment of linear regulator 500 may provide a chip area effective solution for this kind of system with multiple LDOs.

In linear regulator 500, instead of using a reference amplifier and reference filter for each LDO, the output resistor dividers are used for output voltage adjustment.

Noise Analysis

Approximate output noise voltage $E_{n_out}$ of a conventional LDO may be expressed as follows:

$$E_{n_out}=\sqrt{E_{nv_outdiv}^2+E_{nv_ref}^2+E_{nv_erramp}^2},$$

where $E_{nv_outdiv}$, $E_{nv_ref}$, and $E_{nv_erramp}$ are portions of the output noise of LDO caused by resistive output divider, reference block, and error amplifier, respectively.

Considering the thermal noise only, the noise portion from the output divider $$E_{nv_outdiv} = E_{n_R1R2ser}\cdot\sqrt{\frac{R1}{R2}} = E_{n_R1R2par}\cdot G,$$

where R1 and R2 are resistance of upper and lower resistor of the divider, respectively, $E_{n_R1/R2ser}$ and $E_{n_R1R2par}$ are the thermal noise voltage caused by resistors R1 and R2 connected in series or in parallel, respectively, and G is the voltage gain of the LDO. Here, $$E_{n_R1R2ser}=\sqrt{4kt(R1+R2)\Delta f},$$

$$E_{n_R1R2par}=\sqrt{4kt\Delta f\cdot R1R2/(R1+R2)}$$

$$G=(1+R1/R2)=V_{out}/V_{ref}$$

with k—Boltzmann's constant, T—absolute temperature, Δf—frequency bandwidth, $V_{ref}$—reference voltage, and $V_{out}$—output voltage.

The noise value $E_{n_ref}$ of the reference block depends on a number of factors (such as the schematic of the reference block including band-gap unit, the bias voltage/current of the block, the existence of external/internal noise filtering etc.). For example, in one embodiment the value of the measured/estimated reference noise (10 Hz-100 kHz bandwidth) at the input of error amplifier ranges from 1-2 μV (with internal low-pass filter having very low cut-off frequency) up to 1-2 mV (low-power solution without low-pass filter (LPF) having very low supply current).

Output noise portions due to noise of reference block and error amplifier may be expressed as $$E_{nv_ref}=G\cdot E_{n_ref}$$

and $$E_{nv_erramp}=G\cdot E_{n_erramp}$$

respectively, where $E_{n_erramp}$ is the input referred noise of the error amplifier.

Although capacitor $C_F$ of the filter is connected between the output of the LDO and pin/contact of filter resistor (transistor) $M_F$, these components form a LPF due to relatively low output impedance of the LDO (compared with impedance of the output divider with the output noise filter). For the main feedback signal, capacitor $C_F$ introduces a transfer zero that may be used for frequency correction of the LDO.

In order to effectively suppress both thermal and flicker noise of the divider (and filter), typically the cut-off frequency of the filter should be below 1 Hz. Since the value of the differential resistance of MOS can be selected of several GOhms, capacitance of the filter capacitor should typically be 10-20 pF and the area occupied by filter is relatively small. Usage of area-effective MOS capacitance may be recommended for higher output voltages when the voltage drop Vout-Vref sufficiently exceeds the threshold voltage of $M_F$.

Figure 6:
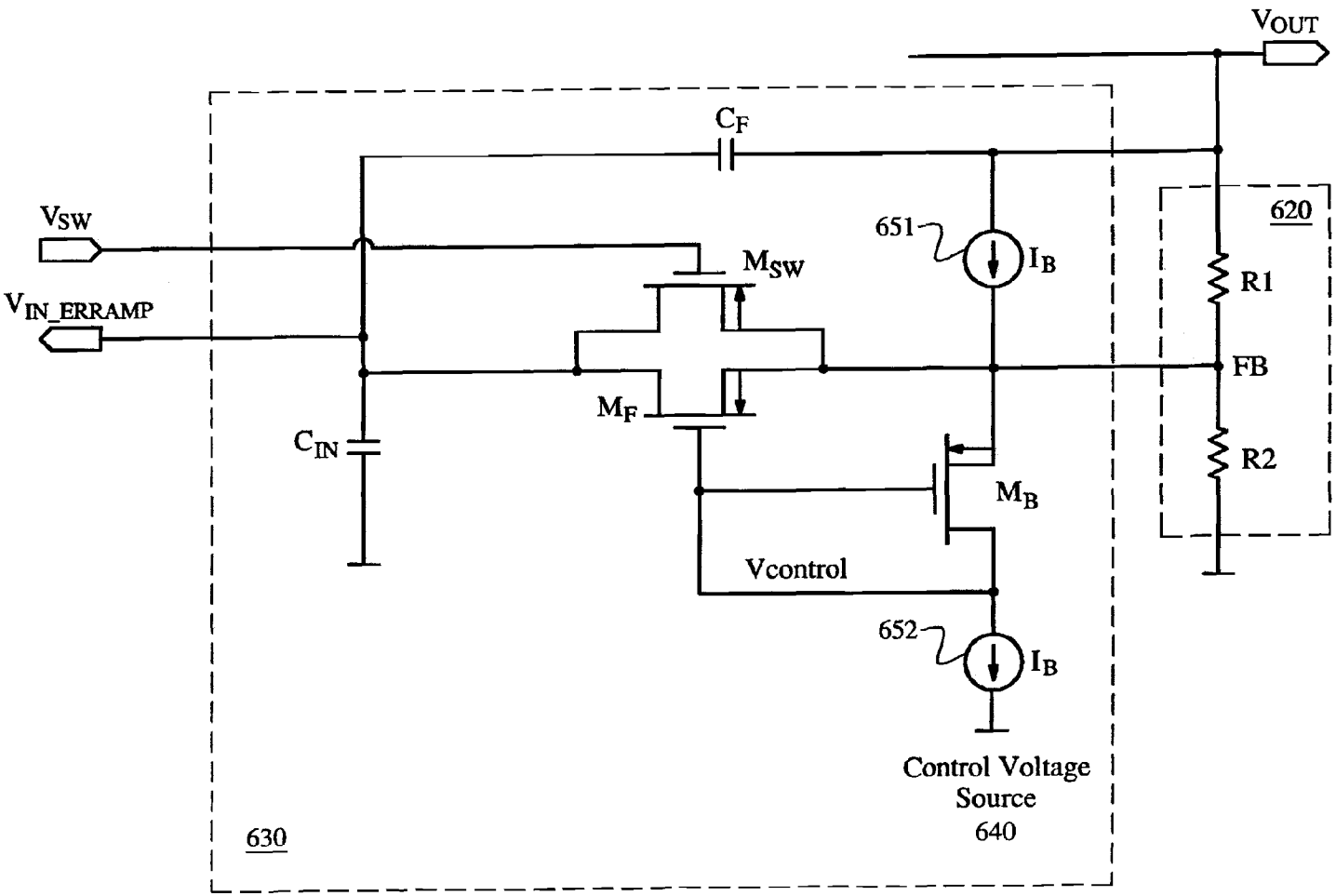
FIG. 6 schematically illustrates an embodiment of the output noise filter and voltage divider of FIG. 4.

A limiting factor that does not allow usage of smaller $C_F$ values (even when increasing the MOS resistance) is capacitive dividing of output signal due to (parasitic) capacitance $C_{IN}$ (as illustrated in FIG. 6), which mainly accounts for the input capacitance of error amplifier (including Miller capacitance that can be minimized using a cascaded input stage of amplifier). In realistic error amplifiers with small offset voltage and flicker noise contribution, the channel area of input transistor is typically about one thousand $\mu m^2$. Accordingly, the value of the parasitic capacitance can be several picoFarads.

The second main contribution to $C_{IN}$ may give the parasitic capacitance of the capacitor $C_F$ that is connected between the lower plate of capacitor and the chip substrate. In the case of typical technology, it is about 10-15% of the main capacitance. To remove this portion of parasitic capacitance, the lower plate may be connected to the output of LDO. Using a four-pin capacitor in n- or p-well and a (bootstrapping) connection of the upper plate along with the well contact to output of LDO not only removes the parasitic capacitance of the $C_F$ from $C_{IN}$, but adds it to the main capacitance giving reduction of the capacitor area of 10-15%.

To estimate the effect of parasitic capacitance $C_{IN}$ to the total output noise $E_{nt_out}$, the next simplified expression may be used:

$$E_{nt_out}=E_{n_out}\cdot(1+C_{IN}/C_F).$$

For example, having $C_F$=15 pF, $C_{IN}$=3 pF, a noise of error amplifier of 10 μV referred to input, and ideal reference and noise filters totally suppressing the noise, the output noise of LDO is 20% higher (12 μV) than in ideal case of $C_{IN}$=0. It is equivalent to adding of 6.6 μV non-correlated noise to the input. Accordingly, $C_F >> C_{IN}$ is desirable in this example.

The embodiment illustrated in FIG. 6 shows one way to control the resistance $M_F$ of the output noise filter, which ensures better protections against disturbances if the reference filter and output noise filter blocks are placed relatively far from each other. Accordingly, as illustrated in FIG. 6, similar bias currents for both of blocks from multi-output bias generator are used.

FIG. 6 schematically illustrates an embodiment of voltage divider 620 and output noise filter 630, which may be employed as embodiments of similarly-named circuits in FIG. 4. Control voltage source 640 includes transistor Msw, transistor MB, bias current source 651, and bias current sink 652. $C_{IN}$ represents parasitic capacitance as discussed in greater detail above.

Bias current source 651 and bias current sink 652 are each arranged to provide a bias current substantially equal to bias current $I_B$. Signal Vsw is asserted during start up, and unasserted after start up. Transistor Msw operates as a switch. During start up, transistor switch Msw is closed, and after start up, transistor switch Msw is open. Transistor Mb provides control voltage Vcontrol based, in part, on bias current $I_B$.

Bias current source 651 may be employed for additional compensating current to the divider output, to avoid the output dc shift $\Delta V_{OUT}$ that can be estimated as follows:

$$\Delta V_{OUT}=i_b\cdot R1.$$

Using, for example, for a 1 μA divider current $i_{div}$, 1.2V reference voltage $V_{REF}$, 3V output voltage $V_{OUT}$ (i.e. R1=1.8 Mohm, R2=1.2 Mohm), and a non-compensated 3 nA control current $i_b$, there is a dc shift of $\Delta V_{OUT}$=5.4 mV (0.18%), that is typically acceptable but not in case of a precise LDO. Maximum relative error for high output voltage approaches to the value of $$\partial V_{OUT}=\Delta V_{OUT}/V_{OUT}=i_b/i_{div}$$

with $$i_{div}=V_{REF}/R2$$

Accordingly, the maximum relative error approaches to 0.3% in this case. For minimum output voltage ($V_{out}=V_{ref}$), the maximum relative error equals substantially 0.

For a precise LDO, compensating with a matched current may be employed, as shown in FIG. 6, especially accounting for variations of absolute value of bias current $I_B$.

Figure 7:
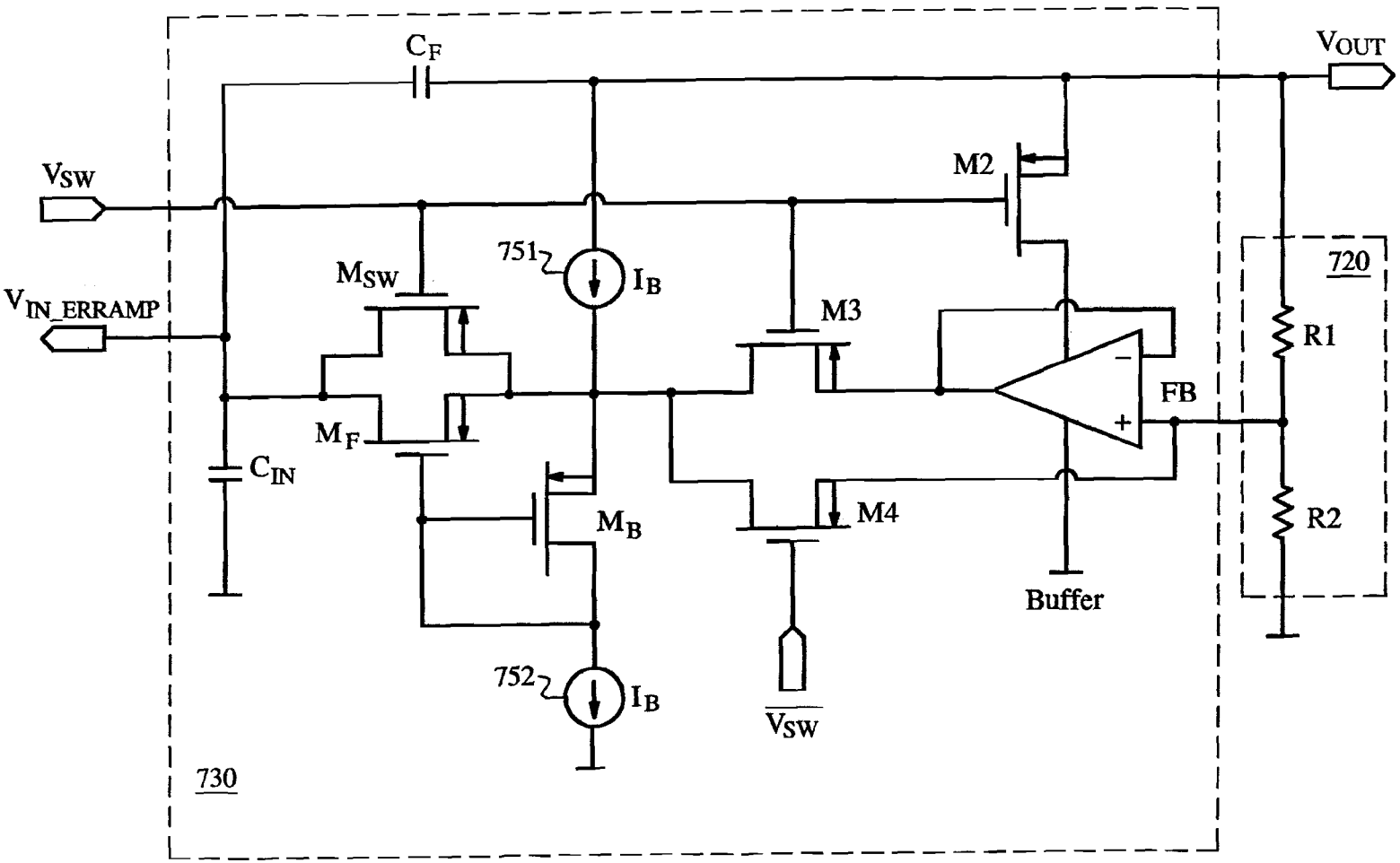
FIG. 7 schematically illustrates an embodiment of the output noise filter and voltage divider of FIG. 6, arranged in accordance with aspects of the present invention.

FIG. 7 schematically illustrates an embodiment of voltage divider 720 and output noise filter 730, which may be employed as embodiments of similarly-named circuits in FIG. 6. Output noise filter 730 further includes op amp A1 and transistor M2-M4.

Op amp A1 is arranged to operate as a buffer during start-up. During start up, the buffer is enabled, to ensure fast charging of capacitor $C_F$ during start up for reduced start-up time. Transistor M2, M3, and M4 operate as switches, so that, during start-up, switches M2 and M3 are closed and switch M4 is open. This way, the buffer is connected to during start-up. After start up, switches M2 and M3 are open, and switch M4 is closed, so that the buffer is effectively removed.

The above specification, examples and data provide a description of the manufacture and use of the composition of the invention. Since many embodiments of the invention can be made without departing from the spirit and scope of the invention, the invention also resides in the claims hereinafter appended.

What is claimed is:

1. A low drop-out regulator, comprising:

an error amplifier having at least a first input, a second input, and an output;

a pass transistor that is coupled between an input node and an output node, and further coupled to the output of the error amplifier; and an output noise filter, including:

a resistive device that is coupled between a feedback node and the first input of the error amplifier;

a capacitive device that is coupled between the first input of the error amplifier and the output node; and a voltage divider, including:

a first resistor that is coupled between the output node and the feedback node; and a second resistor that is coupled to the feedback node.

2. A circuit for low drop-out voltage regulation, comprising:

a liner regulator, including:

an error amplifier having at least a first input, a second input, and an output; and an output noise filter that is coupled between a feedback node and the first input of the error amplifier, wherein the output noise filter is arranged to provide a filtered feedback signal to the first input of the error amplifier by filtering a feedback signal, such that the output noise filter is arranged to filter out noise associated with a voltage divider, wherein the output noise filter includes:

a capacitive device that is coupled to the first input of the error amplifier, and a resistive devise that is coupled between the feedback node and the first input of the error amplifier.

3. The low-drop out regulator of claim 1, wherein the resistive device includes a resistor that is coupled between the feedback node and the first input of the error amplifier.

4. The low-drop out regulator of claim 1, wherein the resistive device includes a transistor that is coupled between the feedback node and the first input of the error amplifier.

5. The low drop-out regulator of claim 1, further comprising:

a buffer that is arranged to buffer the feedback voltage to provide the buffered feedback voltage to the output noise filter during start-up, and further arranged to be disabled during normal operation.

6. The low drop-out regulator of claim 1, further comprising:

a reference voltage circuit that is coupled to the second input of the error amplifier.

7. The low drop-out regulator of claim 6, further comprising:

a reference noise filter that is coupled between the second input of the error amplifier and the reference voltage circuit.

8. The low drop-out regulator of claim 1, wherein the capacitive device is connected between an error amplifier input node and the output node, the first input of the error amplifier is connected to the error amplifier input node, and wherein the resistive device is coupled between the feedback node and the error amplifier input node.

9. The low drop-out regulator of claim 1, wherein the first input of the error amplifier is coupled to an error amplifier input node, the resistive device is coupled between the feedback node and the error amplifier input node such that there is a current path between the feedback node and the error amplifier input node through the resistive device, and wherein the capacitive device is coupled between the error amplifier input node and the output node such that the error amplifier input node is capacitively coupled to the output node.

10. A low drop-out regulator, comprising:

an error amplifier having at least a first input, a second input, and an output;

a pass transistor that is coupled between an input node and an output node, and further coupled to the output of the error amplifier; and an output noise filter, including:

a resistive device that is coupled between a feedback node and the first input of the error amplifier;

a capacitive device that is coupled between the first input of the error amplifier and the output node;

a voltage divider, including:

a first resistor that is coupled between the output node and the feedback node; and a second resistor that is coupled to the feedback node;

a reference noise filter that is coupled to the second input of the error amplifier;

another error amplifier having at least a first input, a second input that is coupled to the second input of the error amplifier, and an output;

another pass transistor that is coupled between another input node and another output node, and further coupled to the output of said another error amplifier; and another output noise filter, including:

another resistive device that is coupled between another feedback node and the first input of said another error amplifier; and another capacitive device that is coupled between the first input of said another error amplifier and said another output node.

11. The low drop-out regulator of claim 10, further comprising:

a control voltage source having an output, wherein the reference noise filter includes a third capacitive device and a third resistive device; the first resistive device includes a first transistor having at least a gate that is coupled to the output of the control voltage source; said another resistive device includes a second transistor having at least a gate that is coupled to the output of the control voltage source; and wherein the third resistive device includes a third transistor having at least a gate that is coupled to the output of the control voltage source.

12. The low drop-out regulator of claim 11, wherein the control voltage source includes a current source, a current sink, a fourth transistor that is coupled between the current source and the current sink, and a switch that is coupled in parallel with the first transistor, wherein the switch is arranged to be closed during start-up, and open during normal operation.

13. The low drop-out regulator of claim 2, further comprising:

a voltage divider, including:

a first resistor that is coupled between the output node and the feedback node; and a second resistor that is coupled to the feedback node.

14. The circuit of claim 2, wherein the linear regulator further includes a pass transistor that is coupled between an input node and an output node, and further coupled to the output of the error amplifier.

15. The circuit of claim 2, wherein the capacitive device is coupled between the first input of the error amplifier and the output node.

16. The circuit of claim 2, further comprising:

a reference noise filter having at least: an output that is coupled to the second input of the error amplifier; and an input.

17. A circuit for low drop-out voltage regulation, comprising:

a linear regulator, including:

an error amplifier having at least a first input, a second input, and an output; and an output noise filter that is coupled between a feedback node and the first input of the error amplifier, wherein the output noise filter is arranged to provide a filtered feedback signal to the first input of the error amplifier by filtering a feedback signal, such that the output noise filter is arranged to filter out noise associated with a voltage divider;

a reference noise filter having at least: an output that is coupled to the second input of the error amplifier; and an input;

another error amplifier having at least a first input, a second input that is coupled to the second input of the first error amplifier, and an output; and another output noise filter that is coupled between another feedback node and the first input of said another error amplifier, wherein said another output noise filter is arranged to provide another filtered feedback signal to the first input of said another error amplifier by filtering another feedback signal, such that said another output noise filter is arranged to filter out noise associated with another voltage divider.

18. A method for voltage regulation, comprising:

regulating an output, including:

employing a voltage divider to provide a feedback voltage for the output voltage;

providing the feedback voltage to a first input of an error amplifier; and employing the error amplifier to drive a pass transistor such that the pass transistor provides the output voltage; and filtering the feedback voltage before the feedback voltage is provided to the first input of the error amplifier, such that at least some noise associated with the voltage divider is filtered out, wherein filtering the feedback voltage is accomplished with a low-pass filter that includes a capacitive device and a resistive device, and wherein filtering the feedback voltage further includes lowering a resistance that is associated with the resistive device while a start-up is occurring.

19. The method of claim 18, further comprising:

regulating another output voltage, including:

employing another voltage divider to provide another feedback voltage from said another output voltage;

providing said another feedback voltage to a first input of another error amplifier;

filtering a reference voltage;

providing the filtered reference voltage to a second input of said another error amplifier; and employing said another error amplifier to drive another pass transistor such that said another pass transistor provides said another output voltage, wherein regulating the output voltage further includes providing the filtered reference voltage to the second input of the error amplifier.

20. The method of claim 18, wherein regulating the output voltage further includes:

if a start-up is occurring:

buffering the feedback voltage before filtering the feedback voltage;

else disabling the buffering of the feedback voltage.

21. The method of claim 18, wherein the capacitive device is coupled between the first input of the error amplifier and the output voltage.

* * * * *

UNITED STATES PATENT AND TRADEMARK OFFICE

CERTIFICATE OF CORRECTION

PATENT NO. : 7,919,954 B1
APPLICATION NO. : 11/549030
DATED : April 5, 2011
INVENTOR(S) : Vello Mannama et al.

It is certified that error appears in the above-identified patent and that said Letters Patent is hereby corrected as shown below:

On the title page, item (57), in Abstract, in column 2, line 1, delete "low-drop out" and insert -- low drop-out --, therefor.

In column 2 line 45, delete "low-drop out" and insert -- low drop-out --, therefor.

In column 4 line 6, after "current" insert -- . --.

In column 4 line 35, delete "$E_{n_R1/R2ser}$" and insert -- $E_{n_R1R2ser}$ --, therefor.

$$E_{n_R1R2ser}=\sqrt{4kt(R1+R2)\Delta f},$$

$$E_{n_R1R2par}=\sqrt{4kt\Delta f\cdot R1R2/(R1+R2)}$$

In column 4 lines 40-44, delete "$G=(1+R1/R2)=V_{out}/V_{ref}$" and

Signed and Sealed this
Fifth Day of July, 2011

David J. Kappos

David J. Kappos
*Director of the United States Patent and Trademark Office*

$$E_{n_R1R2ser} = \sqrt{4kT(R1+R2)\Delta f},$$

$$E_{n_R1R2par} = \sqrt{4kT\Delta f \cdot R1R2/(R1+R2)}$$

$$G = (1+R1/R2) = V_{out}/V_{ref},$$

insert -- --, therefor.

In column 5 line 43, delete " $E_{nt_out}=E_{n_out}-(1+C_{IN}/C_F).$ " and insert -- $E_{nt_out}=E_{n_out}\cdot(1+C_{IN}/C_F).$ --, therefor.

In column 6 line 24, after " $i_{div}=V_{REF}/R2$ " insert -- . --.

In column 7 line 15, in Claim 2, delete "devise" and insert -- device --, therefor.

In column 7 line 18, in Claim 3, delete "low-drop out" and insert -- low drop-out --, therefor.

In column 7 line 22 in Claim 4, delete "low-drop out" and insert -- low drop-out --, therefor.